US007517268B2

(12) United States Patent
Pehling

(10) Patent No.: US 7,517,268 B2
(45) Date of Patent: Apr. 14, 2009

(54) INFLATABLE ROPE

(75) Inventor: Brian Pehling, Kalispell, MT (US)

(73) Assignee: Grohe Enterprises, Inc., Kalispell, MT (US)

( * ) Notice: Subject to any disclaimer, the term of this patent is extended or adjusted under 35 U.S.C. 154(b) by 0 days.

(21) Appl. No.: 11/772,754

(22) Filed: Jul. 2, 2007

(65) Prior Publication Data

US 2009/0011668 A1 Jan. 8, 2009

Related U.S. Application Data

(60) Provisional application No. 60/947,595, filed on Jul. 2, 2007.

(51) Int. Cl.
*B63C 9/26* (2006.01)

(52) U.S. Cl. ..... 441/84

(58) Field of Classification Search ..... 441/84
See application file for complete search history.

(56) References Cited

U.S. PATENT DOCUMENTS 411,161 A * 9/1889 Maynard ..... 441/84
3,972,386 A 8/1976 Hayslip
4,193,219 A 3/1980 Pogue
4,935,152 A 6/1990 Gonzales
5,341,758 A * 8/1994 Strickland ..... 114/253
5,694,755 A * 12/1997 Fr.o slashed.ystad ..... 57/211
7,347,757 B1 * 3/2008 Lanthier ..... 441/122
2004/0202805 A1 * 10/2004 Chroman ..... 428/34.1
2007/0034248 A1 2/2007 Romano

OTHER PUBLICATIONS

"Rescue Solutions International: The Global Leader in Intrinsically Safe Line-Throwing Equipement," <http://www.rescuerocket.com/> [retrieved Jun. 30, 2007].
"Rapid Entering and Boarding System: Grapnel Launcher," H. Heriksen Mek. Verksted A/S, Tønsberg, Norway, 2 page brochure.

* cited by examiner

*Primary Examiner*—Jesus D Sotelo
(74) *Attorney, Agent, or Firm*—Christensen O'Connor Johnson Kindness PLLC

(57) ABSTRACT

An inflatable rope comprises three layers, a bladder, a sheath, and a fitted, perforated plastic bag to keep the inflatable rope in a compressed form. The compressed form can be hurled through the air at great distance to a person overboard. The inflatable rope can be inflated to a size that eases the ability of the person, who has lost dexterity in frigid water, to hold on to it for rescuing.

5 Claims, 8 Drawing Sheets

INFLATABLE ROPE

CROSS-REFERENCE TO RELATED APPLICATION

This application claims the benefit of U.S. Provisional Application No. 60/947,595, filed Jul. 2, 2007, which is incorporated herein by reference.

BACKGROUND

A rope is a large stout cord of strands of fibers or wire twisted or braided together for strength. The making of rope dates to ancient times. Originally, strands of fibers were twisted by hand, until the Egyptians developed tools to make ropes from papyrus fibers and leather strips. Hemp, used in Asia and adopted in Europe, became the chosen material for ropes until recently, when it was replaced by Manila hemp, an unrelated plant from the Philippines. Synthetic fibers supplanted Manila hemp as the prime rope material in the 1950s.

Working with ropes is a vital part of many industries and particularly essential to seafaring. Nineteenth century sailors knew and used hundreds of knots, some simple and others exceedingly complicated, each for a specific purpose. Accidents are common on ships, such as when a seaman falls into the water—for which an English word "overboard" was coined to succinctly capture the situation in the twelfth century. In cold waters, as the victim is experiencing hypothermia, his hands and fingers lose dexterity and he cannot hold on to a thin rescue rope that is thrown towards him. Larger diameter ropes, however, are too heavy to throw to a long distance where the victim may be located in the waters.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with various aspects of the invention, an article of manufacture form of the invention includes an inflatable rope, which comprises a bladder formed from plastic to receive, transport, and contain an inflatable medium. The inflatable rope also comprises a sheath formed from a weave of man-made fibers that expands or compresses. The inflatable rope further comprises a fitted, perforated plastic layer into which the bladder and the sheath are rolled or folded so as to allow the inflatable rope to be wound into a spool housed in a drum.

In accordance with another aspect of the invention, a system form of the invention includes a system for hurling an inflatable rope, which comprises the inflatable rope having three layers including a bladder, a phosphorescent sheath, and a fitted, perforated plastic layer and being wound into a spool. The system also comprises a drum for storing the spool and for containing a source of radiation to irradiate the phosphorescent sheath through the fitted, perforated plastic layer. The system further comprises a device that propels a distal end and a portion of the inflatable rope toward a person in water.

In accordance with another aspect form of the invention, a method form of the invention includes a method for containing a chemical spill, which comprises unwinding a spool of a first inflatable rope made from an ultra high molecular weight polyethylene to encompass an area of the chemical spill in water. The method also comprises pumping a nostril of the first inflatable rope with an inflatable medium while a curtain attached to the bottom of the first inflatable rope unfurls toward the water. The method further comprises turning on light emitting diodes on the top of the first inflatable rope to aid in visibility of the location of the first inflatable rope and the chemical spill.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
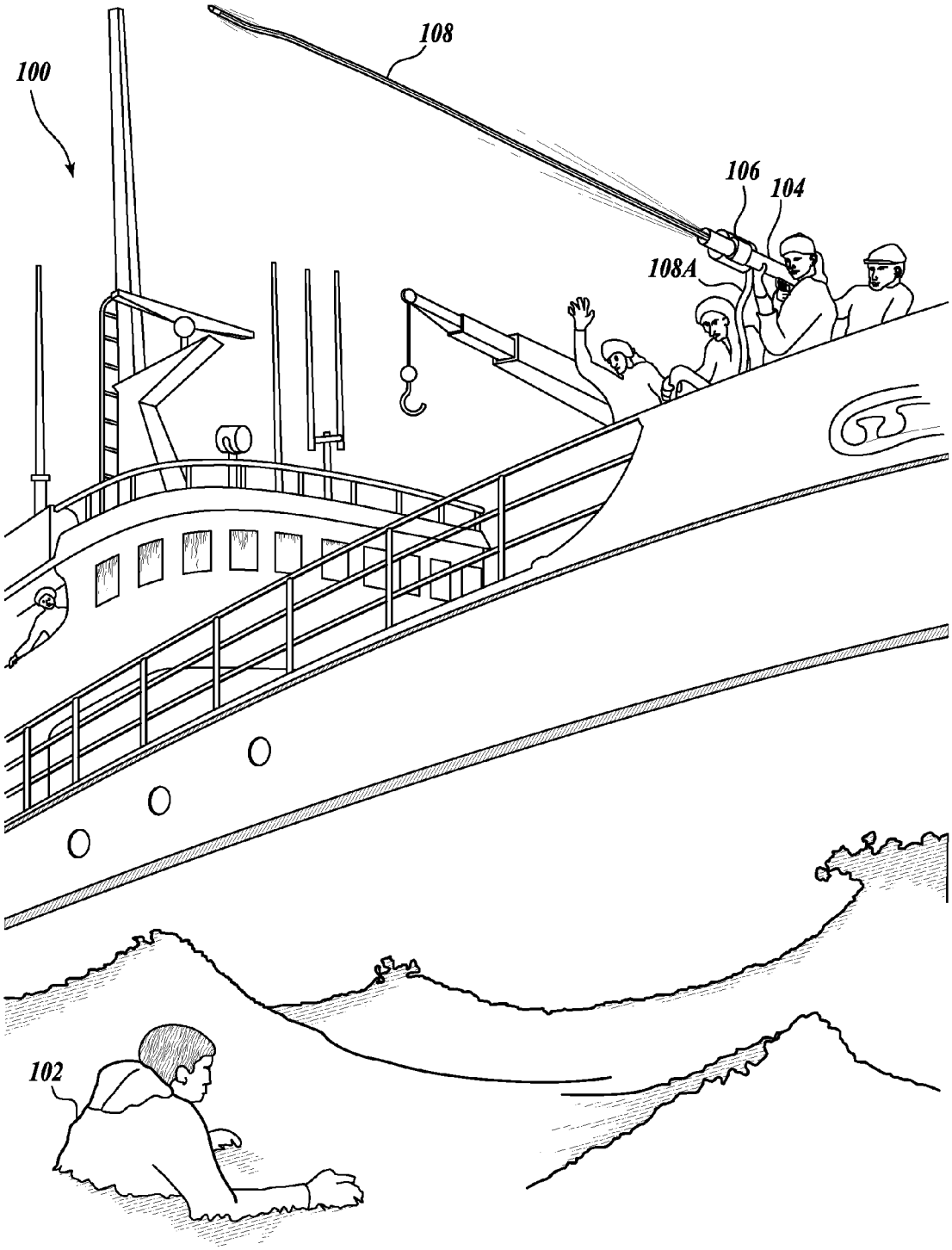
FIG. 1 is a pictorial diagram illustrating an exemplary application of an inflatable rope, according to one embodiment of the present invention.

Unpredictability is one among many risks facing those at seas and even on minor waterways. Ocean marine insurance, one of the oldest forms of insurance, recognizes the need for mitigating against loss from the dangers experienced by boats, cargo, and passengers. One of those dangers is illustrated by FIG. 1 in which a person 102 is overboard. A boat 100 includes a vehicle from which the person 102 fell off, or a ship from a rescuing organization, such as the Coast Guard. When the person 102 is overboard and he wears a radio-frequency tag, a radio-frequency receiver on the boat 100 will annunciate an alert signal to others on board the boat 100.

On the boat 100 are several deckhands. Generally, it will take too long to steer the boat 100 to orient the boat to rescue the person 102. A quicker rescuing operation is needed. In the case illustrated in FIG. 1, some of the deckhands recognize that the person 102 is in the water and one of the deckhands has picked up a device 104 that hurls a projectile, which can propel an inflatable rope 108 towards the person 102. In one embodiment, the inflatable rope 108 can be hurled up to about 200 feet from the boat 100. Any suitable device that hurls a projectile, such as the inflatable rope 108, can be used. One suitable device includes a grapnel launcher manufactured by H. Henriksen Mekaniske Verksted A/S, but any suitable devices can be used.

The device 104 is fitted with a drum 106 in which the inflatable rope 108 is stored in a spool like fashion. The inflatable rope 108 has a distal end and a proximal end. The spool is wound into a cylinder-like shape so that the distal end protrudes from the center of the spool at one end of the spool and the proximal end protrudes from the center of the spool at the other end of the cylinder. The spool is placed inside a drum 106, which is coupled to the device 104, so as to allow the device 104 to propel, at first, the distal end of the inflatable rope, and after which, a portion of the inflatable rope connected to the distal end toward the person 102.

The inflatable rope 108 as hurled from the device 104 is manufactured so that it is initially small in diameter so as to easily cut through the air to quickly reach the person 102. Its small shape is maintained by a small diameter, elongated plastic bag that has a perforation to allow the inflatable rope 108 to tear the small diameter, elongated plastic bag, and emerge when it is inflated. When a desired portion of the inflatable rope 108 has been propelled toward the person 102, the inflatable rope 108 is inflated using its proximal end 108*a*. FIG. 1 shows a deckhand holding and coupling the proximal end 108*a* of the inflatable rope 108 to a source of air (not shown) or other medium (gas, solid, or liquid) to inflate the inflatable rope 108.

Figure 2:
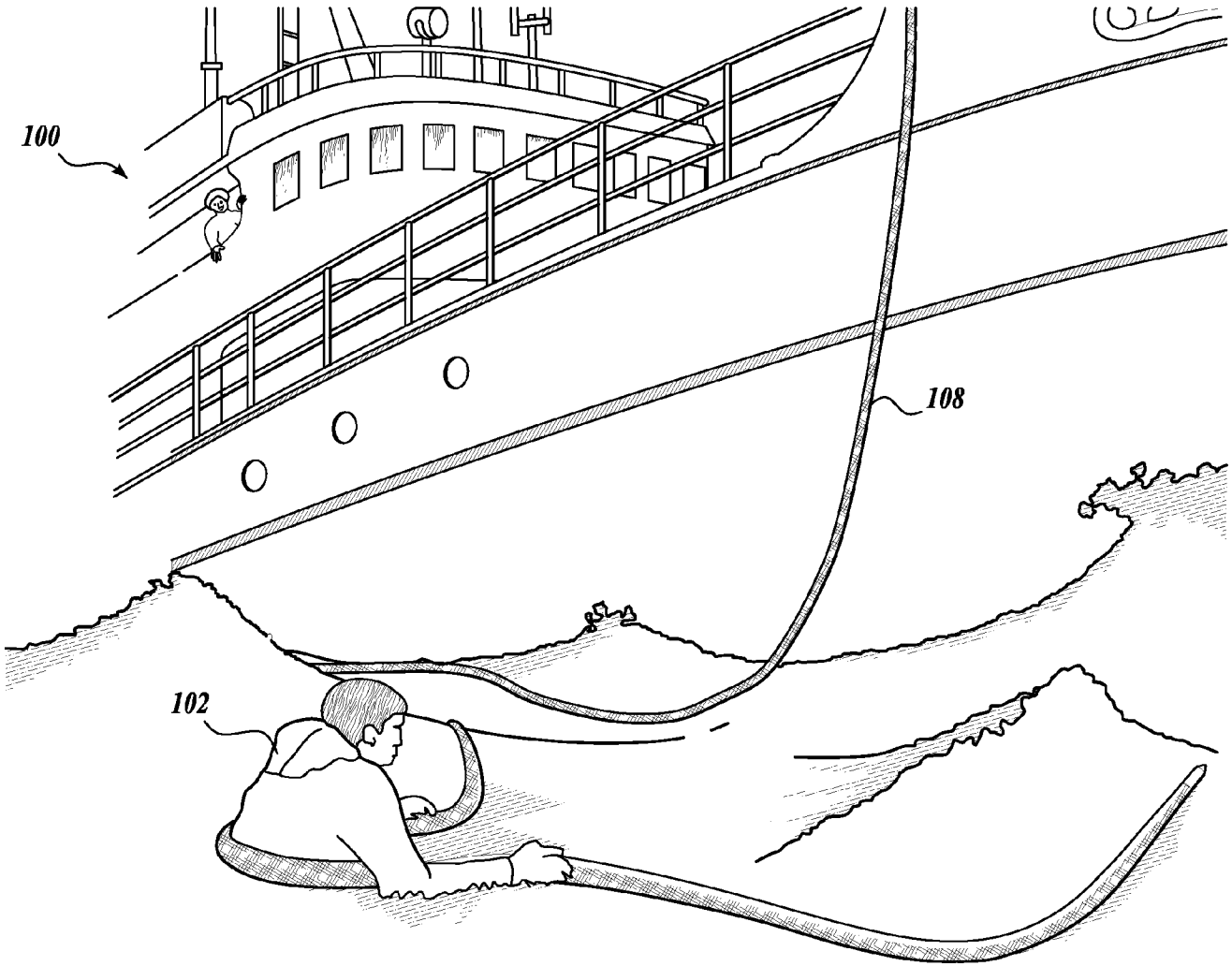
FIG. 2 is a pictorial diagram illustrating an exemplary application of an inflatable rope, according to one embodiment of the present invention.

In one embodiment, the proximal end 108*a* can be coupled to a wench-like mechanism to pull the person 102 toward the boat 100. In another embodiment, the device 104 can include a wench that retrieves the hurled portions of the inflatable rope 108 and thereby pulls the person 102 to safety. FIG. 2 illustrates the inflated inflatable rope allowing the person 102 to grab hold for the deckhands to pull the person 102 to safety. In one embodiment, the inflatable rope 108 can be inflated so that it expands to about 150% of its original, uninflated size.

Figure 3:
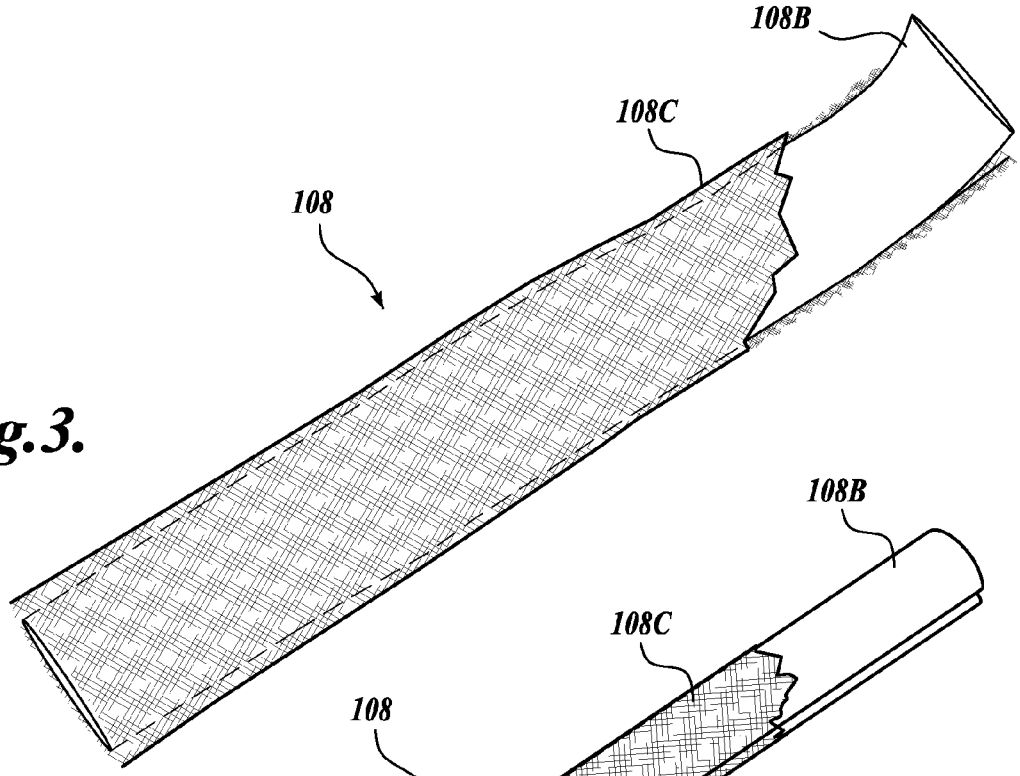
FIG. 3 is a perspective diagram illustrating exemplary layers of an inflatable rope, according to one embodiment of the present invention.
Figure 4:
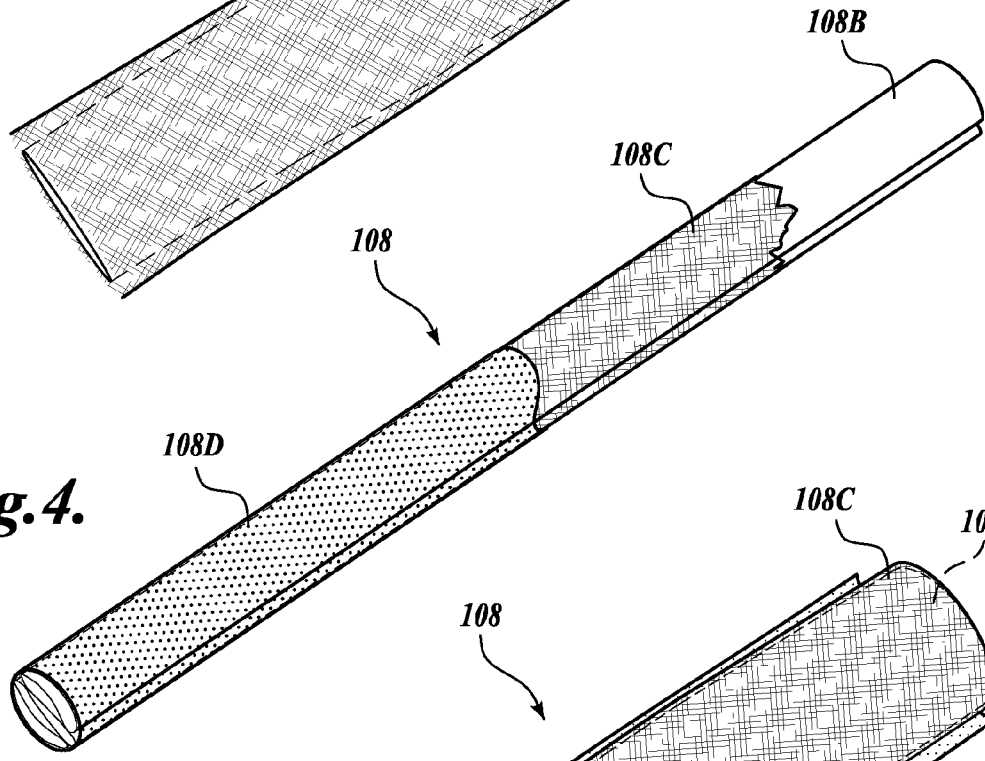
FIG. 4 is a perspective diagram illustrating exemplary layers of an inflatable rope, according to one embodiment of the present invention.

The inflatable rope 108, in its natural, uncompressed, and uninflated form, includes at least two layers 108*b*, 108*c* as illustrated in FIG. 3. The layer 108*b* is a bladder formed from a suitable material into which a gas, such as air, can be pumped to cause the layer 108*b* to expand into a suitable diameter, such as 3 inches. Any suitable material may be used to form the bladder of the layer 108*b*, such as plastic, as long as it allows the bladder to receive, transport, and contain an inflatable medium. The layer 108*c* is a sheath, which is woven from man-made fibers, such as polyethylene terephthalate, a thermoplastic polymer resin in the polyester family. The weave of the sheath of the layer 108*c* provides the tensile strength of the inflatable rope 108 while the bladder of the layer 108*b* allows the inflatable rope 108 to be inflatable or compressible. Any suitable weave pattern can be used as long as it allows the sheath of the layer 108*c* to expand with the expansion of the bladder of the layer 108*b*.

Both the sheath of the layer 108*c* and the bladder of the layer 108*b* can lay flat allowing both layers 108*b*, 108*c* to be rolled or undulated to form multiple compressed folds. The shape of the layers 108*b*, 108*c* formed after being rolled or folded can be maintained by slipping a fitted, perforated plastic layer 108*d* over the rolled or folded layers 108*b*, 108*c*. The inflatable rope 108 with the three layers 108*b*, 108*c*, and 108*d* can be wound into a spool, a center of which at one end protrudes the distal end of the inflatable rope 108 and at the other end protrudes the proximal end. As previously discussed, the distal end of the inflatable rope 108 along with a portion of the inflatable rope 108 will be hurled to the person 102 while the proximal end of the inflatable rope 108 remains behind to be tethered to the boat 100 and is coupled to a source of air or other medium to inflate the inflatable rope 108.

Figure 5:
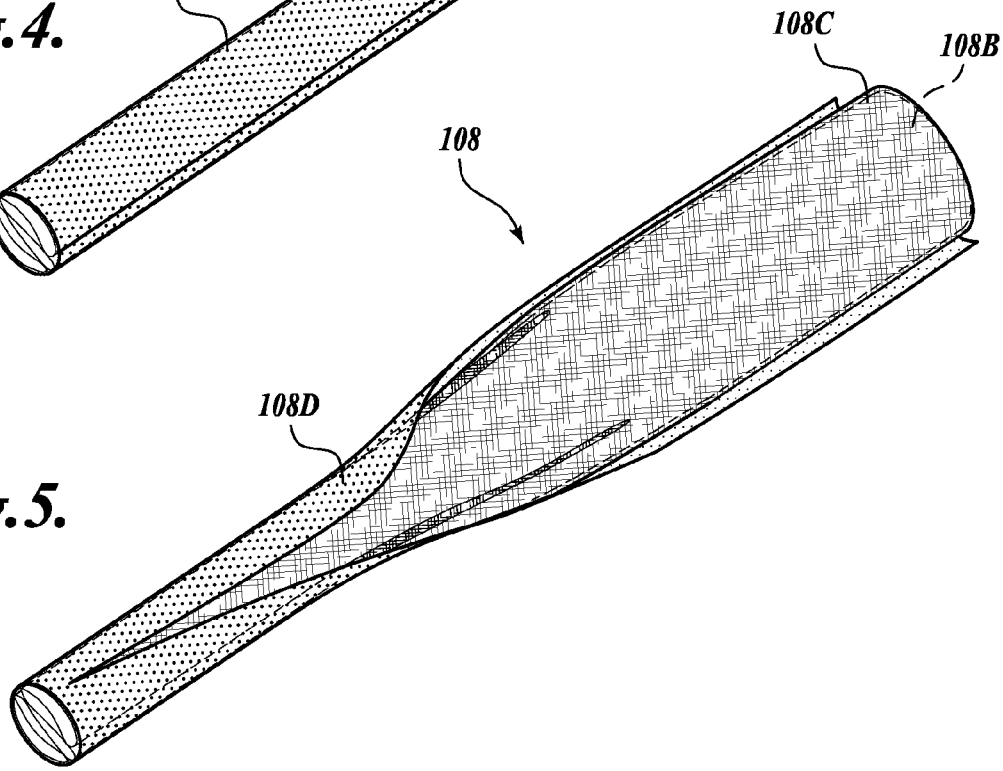
FIG. 5 is a perspective diagram illustrating an exemplary inflated inflatable rope, according to one embodiment of the present invention.
Figure 6:
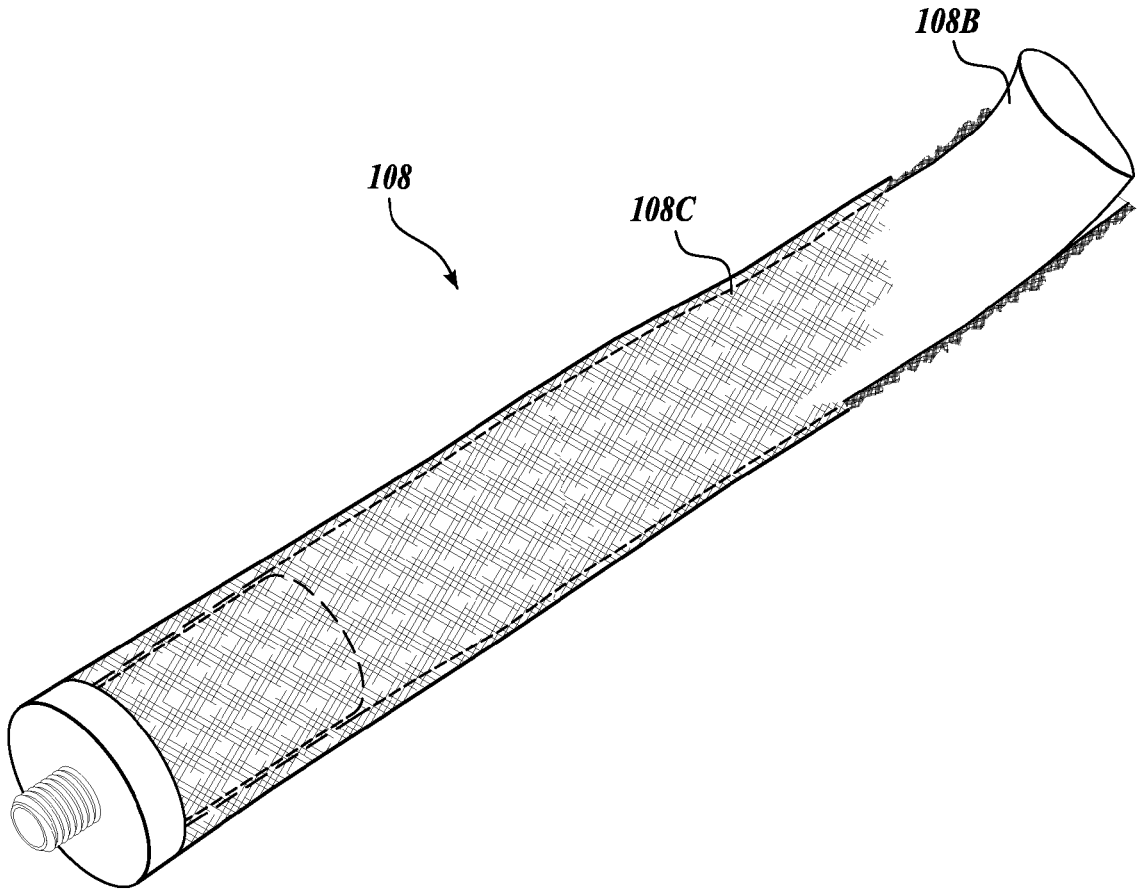
FIG. 6 is a perspective diagram illustrating exemplary layers of an inflatable rope including an exemplary threaded nostril.

As the inflatable rope 108 is pumped with air or another suitable medium, the layer 108*d* is torn off along the perforated path allowing the sheath of the layer 108*c* and the bladder of the layer 108*b* to emerge. See FIG. 5. The inflated inflatable rope 108 floats and allows a portion of the person 102 to be lifted from the water. A threaded nostril 110, as shown in FIG. 6, allows the proximal end of the inflatable rope 108 to be coupled to a source of air. In one embodiment, the sheath of the layer 108*c* is painted with a phosphorescent paint, which allows the sheath to absorb radiation at one wavelength followed by a reradiation at another wavelength in a visible color, such as yellow or orange, that continues for a noticeable amount of time after the incident radiation stops. In this embodiment, the spool containing the phosphorescent inflatable rope also contains a source of incident radiation in the drum 106 to charge, periodically and continuously, the phosphorescent paint on the sheath of the layer 108*c*.

Figure 7:
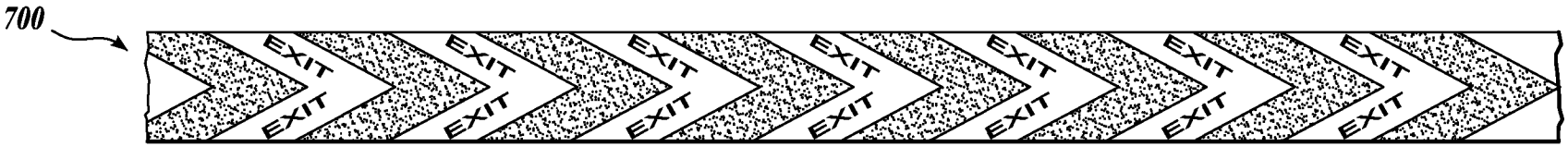
FIG. 7 is a plan view of an exemplary inflatable rope with an exemplary pattern, according to one embodiment of the present invention.

The sheath of the layer 108*c*, in one embodiment, is solid and in a color, such as yellow or orange. In another embodiment, as illustrated in FIG. 7, a v-shape pattern is periodically repeated on the sheath of the layer 108*c*. The v-shape pattern may be comprised of a solid color different from the color comprising the remaining portions of the sheath of the layer 108*c*. In a further embodiment, the remaining portions of the sheath of the layer 108*c* include the word "exit," which is repeated along the two spines of the v-shape pattern. The v-shape pattern, alone or in combination, with the word "exit" allow the inflatable rope 108 to be used by firemen to deliver water to quench a fire in a direction opposite to the apexes of the v-shape pattern and at the same time guide people, who follow the direction pointed by the apexes of the v-shape pattern away from the fire to safety.

Figure 8:
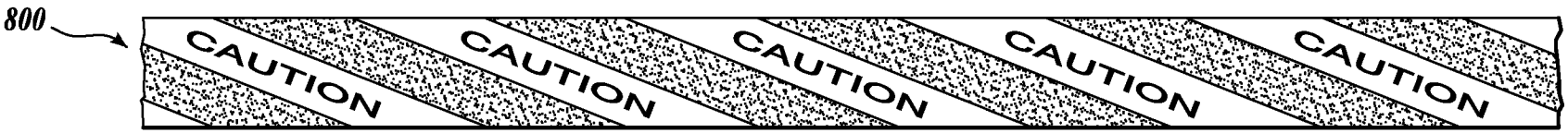
FIG. 8 is a plan view of an exemplary inflatable rope with an exemplary pattern, according to one embodiment of the present invention.
Figure 9:
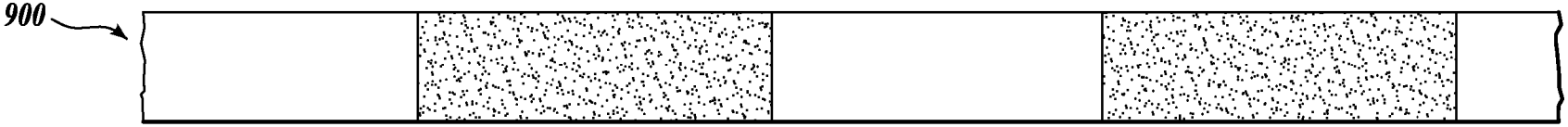
FIG. 9 is a plan view of an exemplary inflatable rope with an exemplary pattern, according to one embodiment of the present invention.

A candy stripe pattern is available, in an additional embodiment, to mark the sheath of the layer 108*c*. See FIG. 8. For some population of people, the candy stripe pattern may be more visually arresting to the eyes. In an added embodiment, the portions of the sheath of the layer 108*c* that lack the candy stripe pattern may include the word "caution" periodically repeated. FIG. 9 illustrates another stripe pattern, in as yet another embodiment, that periodically repeats. Many other patterns are possible as long as they functionally alert people to a situation that requires caution.

Figure 10:
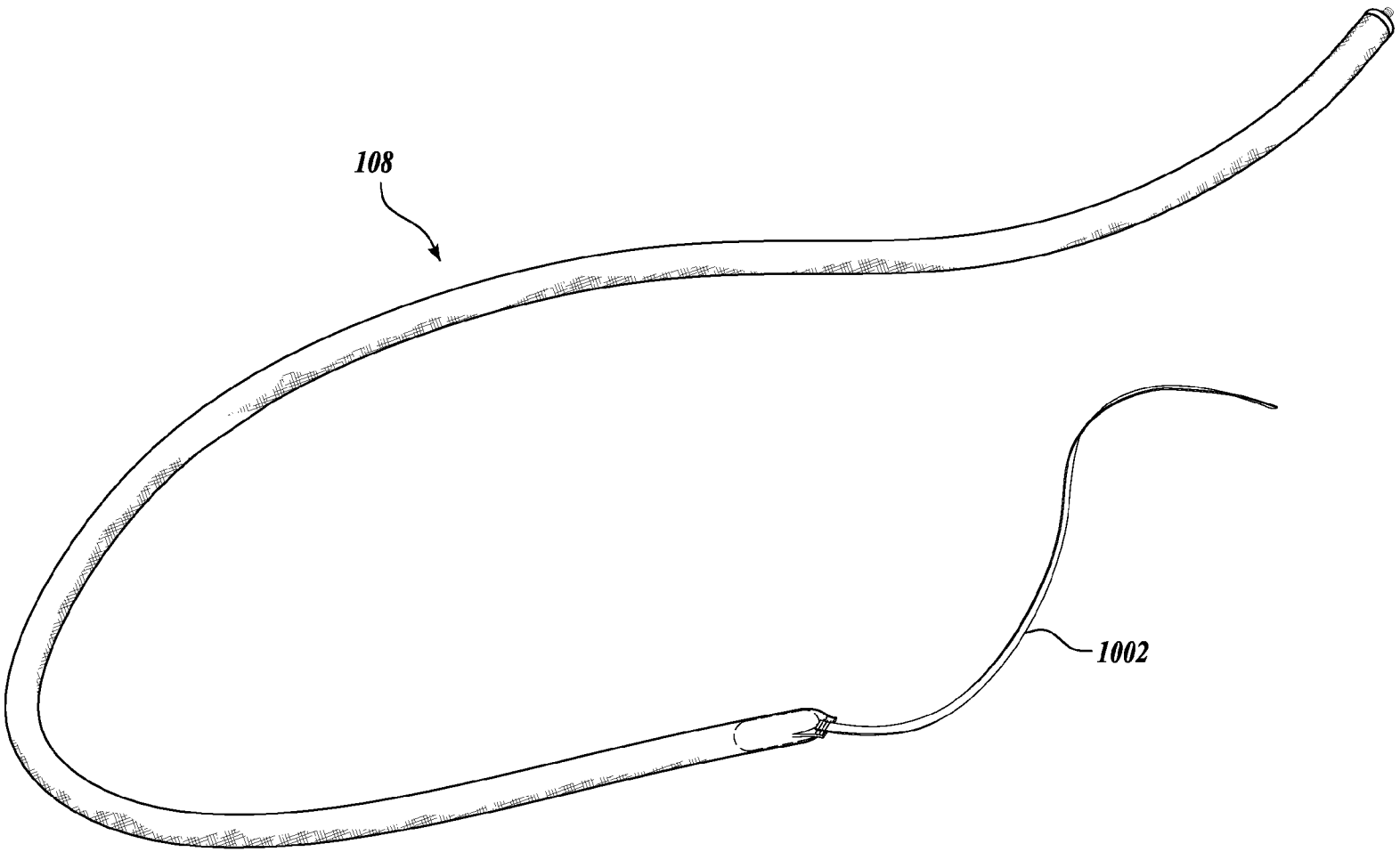
FIG. 10 is a pictorial diagram of an exemplary inflatable rope with an exemplary lanyard, according to one embodiment of the present invention.
Figure 11:
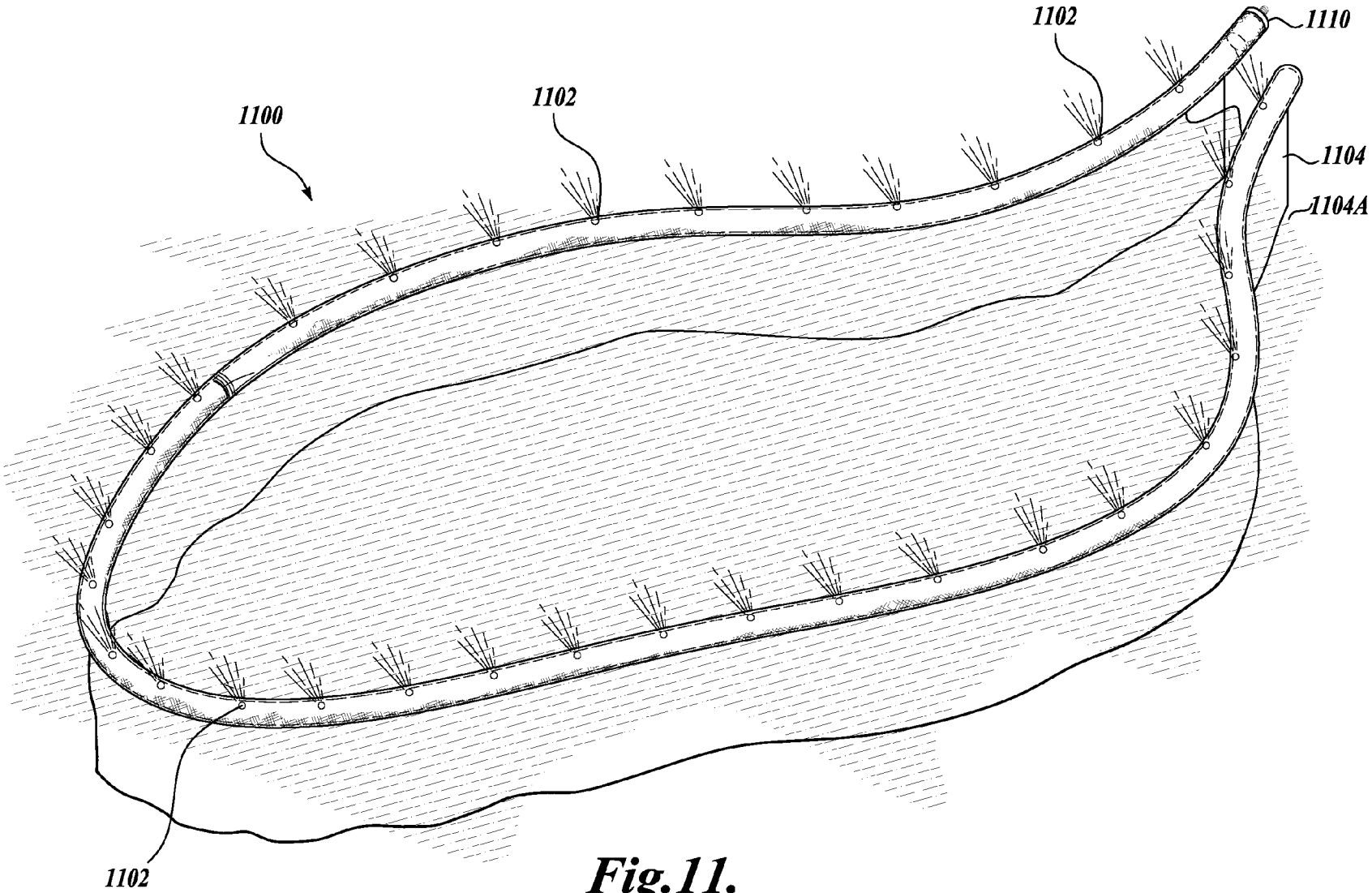
FIG. 11 is a pictorial diagram of an exemplary containment boom, according to one embodiment of the present invention.
Figure 12:
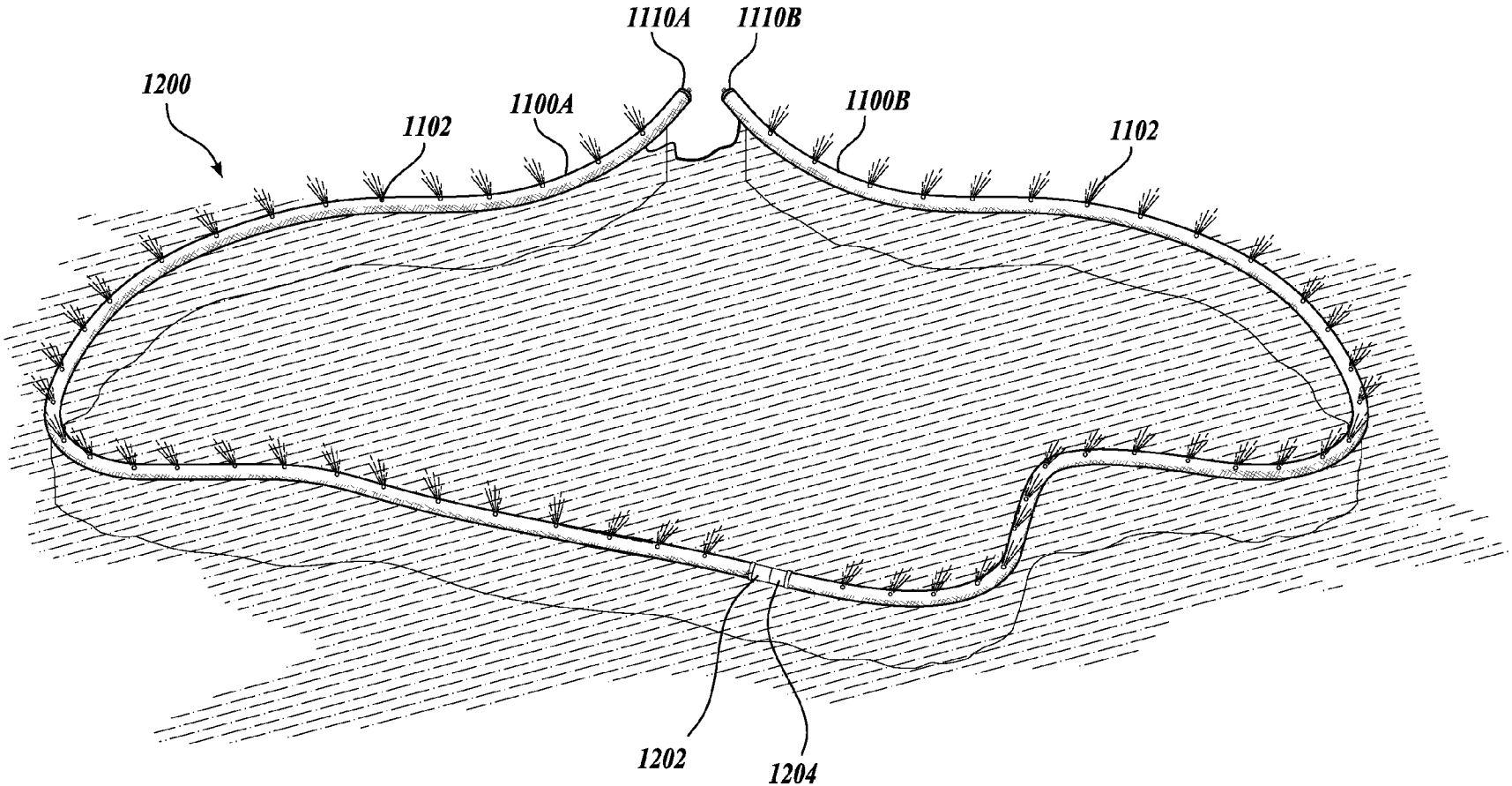
FIG. 12 is a pictorial diagram of exemplary containment booms, according to one embodiment of the present invention.

The inflated inflatable rope 108 is shown in FIG. 10. The nostril 110 is shown at the proximal end of the inflated inflatable rope 108. As previously discussed, the nostril 110 allows air or another medium to be delivered into the bladder of the inflatable rope 108 so as to inflate it. A distal end of a lanyard 1002 is attached to the distal end of the inflatable rope 108. In one embodiment, the lanyard 1002 is manufactured from the same material used to manufacturer the sheath of the layer 108*c*. Preferably, the lanyard 1002 has a similar or longer length than the inflatable rope 108. When the inflatable rope 108 is hurled to the person 102, in a further embodiment, the distal ends of the inflatable rope 108 and the lanyard 1002 are propelled together toward the person 102. A proximal end of the lanyard 1002 is tethered to the boat 100 so as to allow the inflatable rope 108 to be manipulated directionally by the lanyard 1002. More than one lanyard can be coupled to the inflatable rope 108 to provide different controlling options.

An inflatable rope 1100 can be used as a containment boom, which is a temporary floating barrier used to contain an oil or chemical spill. The inflatable rope 1100 includes elements similar to those of the inflatable rope 108, such as a bladder, a sheath, and a nostril 1110. Preferably the sheath of the inflatable rope 1100 is made from an ultra high molecular weight polyethylene, which is highly resistant to corrosive chemicals. The inflatable rope 1100 includes a curtain 1104, which is unfurled when the inflatable rope 1100 is inflated with air or another medium through the nostril 1110. The curtain 1104 preferably is created from the ultra high molecular weight polyethylene used for the sheath of the inflatable rope 1100. In one embodiment, the inflatable rope 1100 is wound into a spool and is stored in a 55 gallon drum or similar canister. The curtain 1104 has a length similar to the length of the inflatable rope 1100. The top of the curtain 1104 is attached to the bottom of the inflatable rope 1100 using a suitable fastening means, such as Velcro. The bottom 1104*a* of the curtain 1104 is preferably weighted so as to ease the process of unfurling and to maintain the drape of the curtain 1104 in the vertical direction to contain the spill. A number of light emitting diodes 1102 are periodically placed along the inflatable rope 1100 to allow visibility at night. In an embodiment, the light emitting diodes 1102 are placed between the bladder and the sheath.

A system 1200 of inflatable ropes 1100*a*, 1100*b* expand an area within which a spill can be contained. Both the inflatable ropes 1100*a*, 1100*b* include nostrils 1100*a*, 1100*b*, adapted to receive air or another medium to inflate the inflatable ropes 1100*a*, 1110*b*. Check valves (not shown) are provided at ends 1202, 1204, to regulate air or another medium that inflates the inflatable ropes 1100*a*, 1100*b*, and are adapted to close when the pressure in both inflatable ropes 1100*a*, 1100*b* is approximately equal. Light emitting diodes 1102 are provided on the top of the inflatable ropes 1100*a*, 1100*b* to provide visibility at night. The system 1200 allows each inflatable rope to be a component that can be interfaced together to expand to contain an enlargement of a spill.

While illustrative embodiments have been illustrated and described, it will be appreciated that various changes can be made therein without departing from the spirit and scope of the invention.

The embodiments of the invention in which an exclusive property or privilege is claimed are defined as follows:

1. An inflatable rope, comprising:

a bladder formed from plastic to receive, transport, and contain an inflatable medium;

a sheath formed from a weave of man-made fibers that expands or compresses; and a fitted, perforated plastic layer into which the bladder and the sheath are rolled or folded so as to allow the inflatable rope to be wound into a spool housed in a drum.

2. The inflatable rope of claim 1, further comprising a nostril coupled to a proximal end of the inflatable rope for receiving air or another inflatable medium.

3. The inflatable rope of claim 1, further comprising one or more lanyards coupled to a distal end of the inflatable rope, the lanyard forming from the weave of man-made fibers.

4. The inflatable rope of claim 1, wherein the man-made fibers are selected from a thermoplastic polymer resin in the polyester family.

5. The inflatable rope of claim 1, wherein the sheath is coated with a phosphorescent pattern selected from a group including solid yellow, solid orange, a v-shape pattern with the word "exit" periodically placed, a candy stripe pattern, and a stripe pattern.

* * * * *